US006790073B2

(12) United States Patent
Wu

(10) Patent No.: US 6,790,073 B2
(45) Date of Patent: Sep. 14, 2004

(54) LOW PROFILE FLEXIBLE CABLE CONNECTOR ASSEMBLY

(75) Inventor: Min-Fang Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/262,390

(22) Filed: Sep. 30, 2002

(65) Prior Publication Data

US 2003/0236024 A1 Dec. 25, 2003

(30) Foreign Application Priority Data

Jun. 20, 2002 (TW) ..... 91209271 U

(51) Int. Cl.[7] ..... H01R 12/24
(52) U.S. Cl. ..... 439/495
(58) Field of Search ..... 439/495, 996, 439/67, 632, 496, 497, 498, 499

(56) References Cited

U.S. PATENT DOCUMENTS 5,921,785 A 7/1999 Ii
5,928,029 A 7/1999 Lam
6,146,172 A 11/2000 Wu et al.
6,155,868 A 12/2000 Wu et al.
6,210,209 B1 4/2001 Wu et al.
6,319,052 B1 * 11/2001 Chang ..... 439/495
6,475,026 B1 * 11/2002 Tseng et al. ..... 439/495
6,589,068 B2 * 7/2003 Yu ..... 439/495
2003/0096530 A1 * 5/2003 Ma et al. ..... 439/495
2003/0104721 A1 * 6/2003 Yu ..... 439/495

OTHER PUBLICATIONS

History of FFC/FPC http://www.avxcorp.com/docs/Catalogs/ffcbist.pdf.

* cited by examiner

*Primary Examiner*—Jean F. Duverne
(74) *Attorney, Agent, or Firm*—Wei Te Chung

(57) ABSTRACT

A flexible cable connector assembly includes an electrical connector (1) and a flexible cable (40, 50). The electrical connector includes an insulative housing (10) defining an elongated slot (15) in a top surface thereof, a number of conductive terminals (20) received in the housing and a stuffer (30) mountable on the housing. The stuffer includes a base plate (31) having a lower surface and opposite side surfaces. A pressing plate (32) extends downwardly from the lower surface of the base plate. The base plate defines a groove in one side surface extending towards the other side surface for allowing the flexible cable to extend laterally therethrough. When the stuffer is mounted onto the housing, the pressing plate is inserted into the slot, the base plate covers the insulative housing and the groove is in communication with the slot.

12 Claims, 5 Drawing Sheets

LOW PROFILE FLEXIBLE CABLE CONNECTOR ASSEMBLY

BACKGROUND OF THE INVENTION

1. Field of the Invention

The present invention is related to a flexible cable connector assembly, and more particularly to a low profile flexible cable connector assembly.

2. Description of Related Art

Flat flexible cables are widely used in electronic devices such as notebook computers, mobile telephones and fax machines etc. Electrical connectors connecting with flexible cables are configured in various types. An article, named "High density FFC/FPC connector" and available at http://www.hiroseeurope.com/pdf/FH16.pdf, introduces features, materials, operation method and specification of high density flexible cable connectors.

U.S. Pat. Nos. 6,210,209, 5,921,785, 5,928,029, 6,146,172 and 6,155,868 disclose several electrical connectors for connecting with flexible cables. However, after the flexible cable and the electrical connector achieve an electrical connection therebetween, extending direction of a tail end of the flexible cable is the same as its inserting direction, thereby increasing occupied space of the whole flexible cable connector assembly. This is particularly true for those electrical connectors which are vertically mounted onto the printed circuit board as disclosed in U.S. Pat. Nos. 6,210,209 and 5,921,785. Since the flexible cable is vertically inserted into a slot of an insulative housing of the electrical connector and the tail end thereof extends vertically, the overall height of the whole flexible cable connector assembly is significantly increased, which goes against the requirement of compact size in the connector industry.

Hence, it is requisite to provide a low profile flexible cable connector assembly having a flexible cable laterally extending at a tail end thereof.

SUMMARY OF THE INVENTION

Accordingly, the object of the present invention is to provide a low profile flexible cable connector assembly having flexible cables horizontally extending at tail ends thereof.

In order to achieve the object set forth, a flexible cable connector assembly in accordance with the present invention comprises an electrical connector and first and second flexible cables. The electrical connector comprises an insulative housing, a plurality of conductive terminals received in the insulative housing and a stuffer. The insulative housing has a top surface defining a slot and the terminals partially project into the slot. The stuffer comprises a base plate and the base plate has a lower surface and opposite side surfaces. A pressing plate downwardly extends from the lower surface. One side surface of the base plate defines a first and a second grooves extending towards the other side surface for allowing the first and the second flexible cables to extend laterally therethrough. Each of the first and the second flexible cables comprises a tail end, and a mating end having metal contacting pads on one side surface thereof for engagement with respective conductive terminals. The mating ends of the first and the second flexible cables are respectively bent downwardly along opposite side surfaces of the pressing plate and extend into the slot of the insulative housing. The tail ends of the first and the second flexible cables extend laterally through the first and the second grooves, thereby reducing the overall height of the flexible cable connector assembly.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
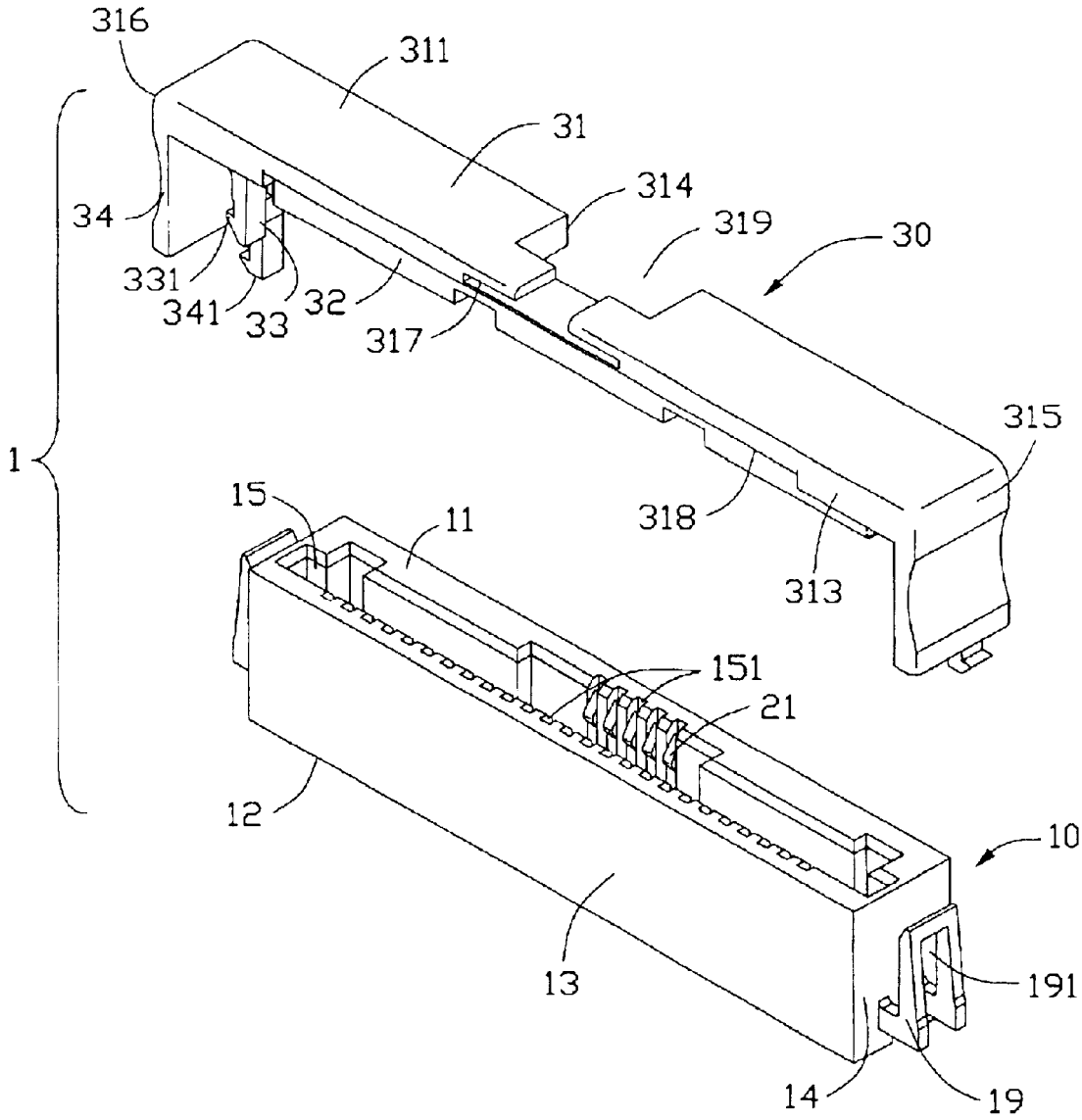
FIG. 1 is an exploded, perspective view of an electrical connector applied in a flexible cable connector assembly in accordance with the present invention.
Figure 2:
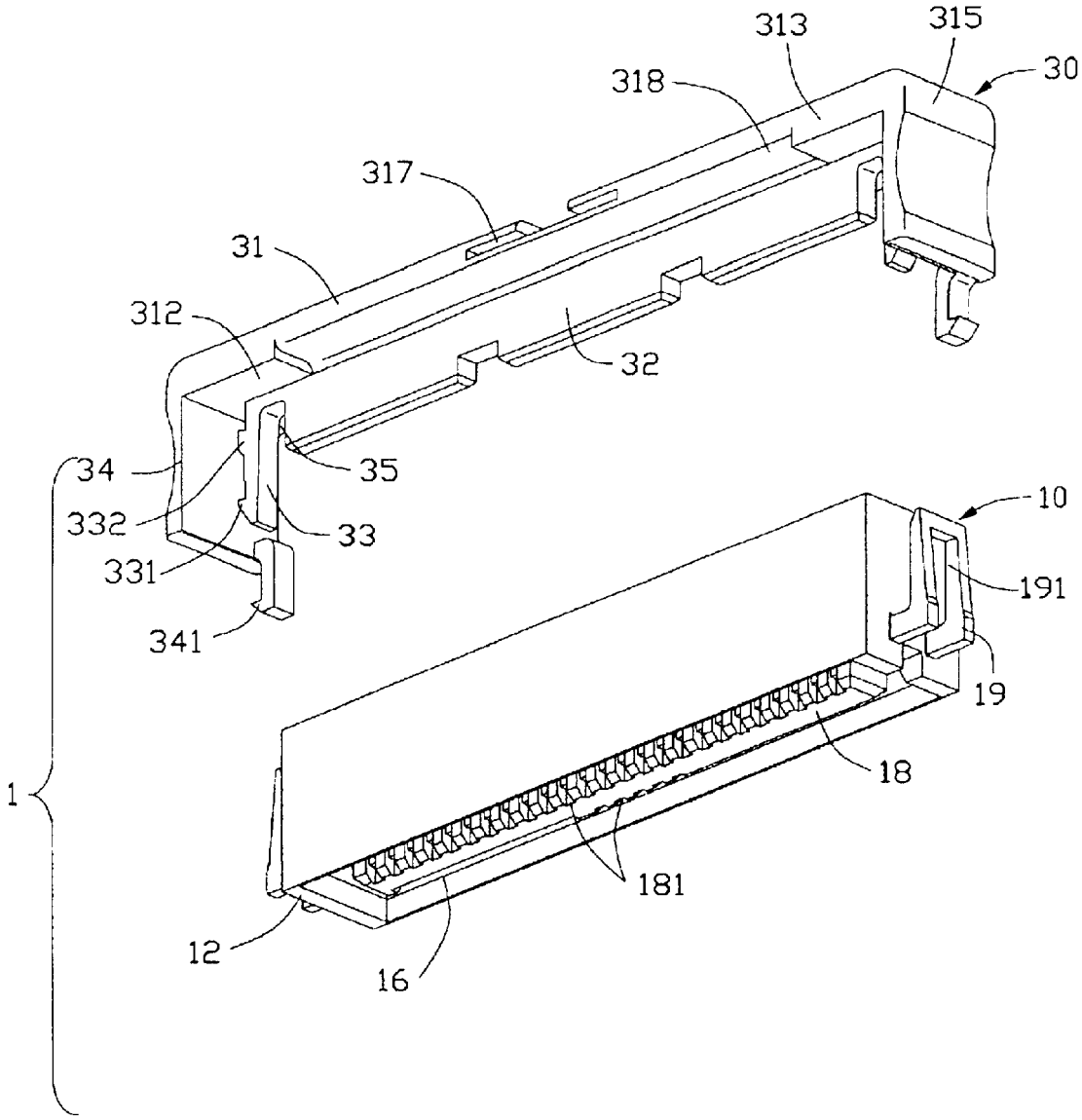
FIG. 2 is an exploded, perspective view of the electrical connector in FIG. 1 from another aspect.
Figure 5:
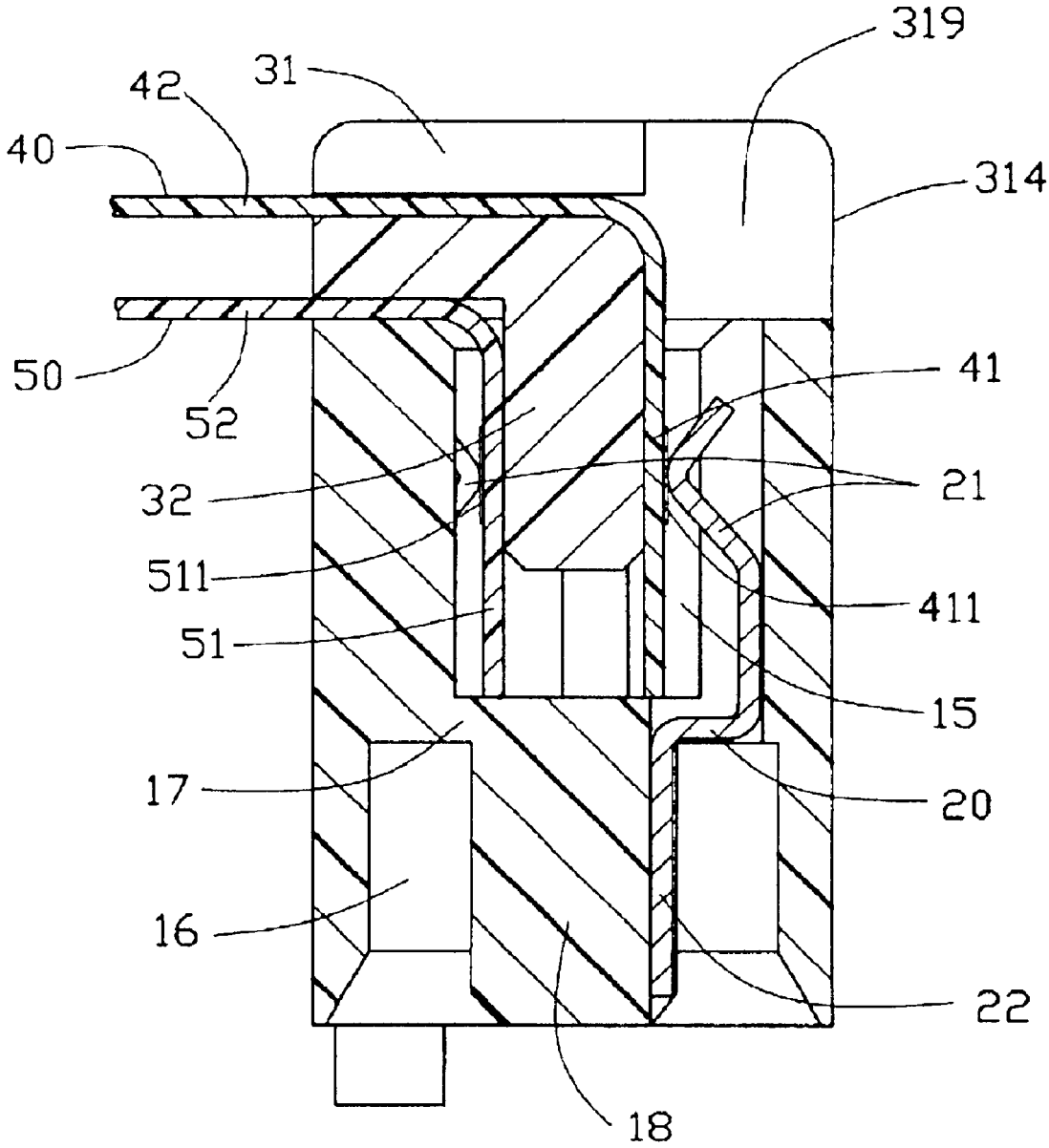
FIG. 5 is a cross-sectional view of the flexible cable connector assembly taken along line 5—5 of FIG. 4.

Referring to FIGS. 1, 2 and 5, a flexible cable connector assembly in accordance with the present invention includes an electrical connector 1 and first and second flexible cables 40, 50. The electrical connector 1 comprises an insulative housing 10, a plurality of conductive terminals 20 received in the insulative housing 10, and a stuffer 30.

The insulative housing 10 comprises a top surface 11, a bottom surface 12, two side surfaces 13 and two end surfaces 14. The top surface 11 defines a slot 15 and a plurality of first terminal passageways 151 on opposite sides of the slot 15. The bottom surface 12 defines a channel 16 for receiving a complementary connector (not shown). A baffle plate 17 is disposed between the slot 15 and the channel 16. A mating plate 18 downwardly extends from the baffle plate 17, and defines the same number of second terminal passageways 181 in opposite side surfaces thereof corresponding to the first terminal passageways 151. Each second terminal passageway 181 passes through the baffle plate 17 and communicates with a corresponding first terminal passageway 151. First and second contact portions 21, 22 of the conductive terminals 20 are respectively received in the first and second terminal passageways 151, 181. Each of the two end surfaces 14 provides a retaining ear 19 having a retaining hole 191.

The stuffer 30 has an elongate, horizontal base plate 31 for covering the top surface 11 of the insulative housing 10. The base plate 31 includes an upper surface 311, a lower surface 312, two side surfaces 313, 314 and two end surface 315, 316. A pressing plate 32 extends downwardly from the lower surface 312 for inserting into the slot 15 of the insulative housing 10. The side surface 313 defines a first groove 317 and a second groove 318 extending towards the other side surface 314 opposite to the side surface 313. The first groove 317 is approximately located in the center of the side surface 313 and in communication with a cutout 319 defined in the side surface 314. The second groove 318 is located under the first groove 317 and extends to the pressing plate 32. A pair of clasping arms 34 extends downwardly from opposite ends of the base plate 31. Each clasping arm 34 provides a hook 341 at a bottom end for firm engagement with the complementary connector. A pair of retaining arms 33 extends downwardly from the lower surface 312 of the base plate 31 and adjacent to the clasping arms 34. Each retaining arm 33 has a first barb 331 and a second barb 332. There is a gap 35 between each retaining arm 33 and the pressing plate 32.

Figure 3:
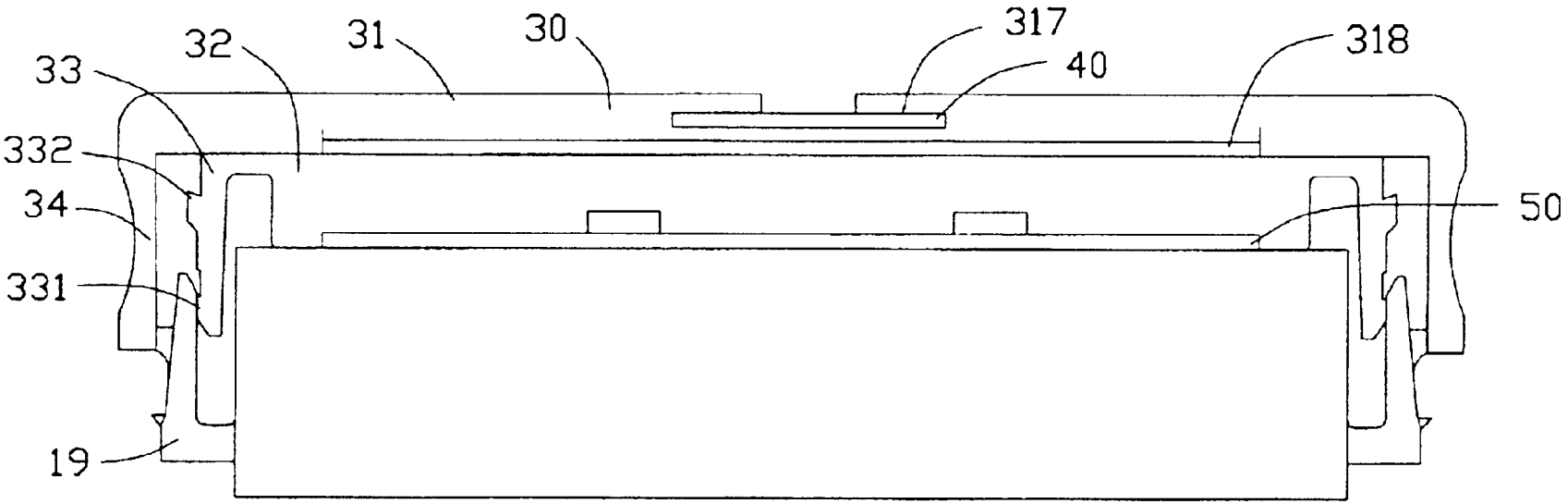
FIG. 3 is a preliminarily assembled, front view of the flexible cable connector assembly, illustrating a stuffer of the electrical connector shown in FIG. 1 not completely assembled.
Figure 4:
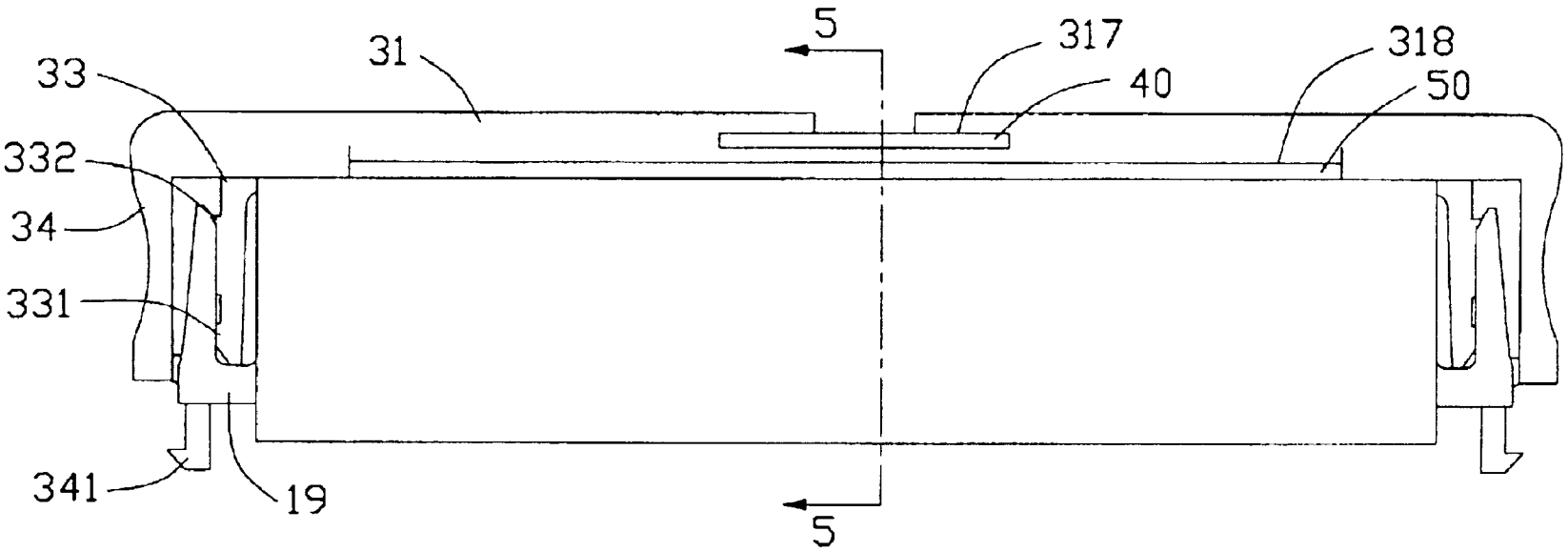
FIG. 4 is a view similar to FIG. 3, but showing the stuffer of the electrical connector shown in FIG. 1 completely assembled.

Referring to FIGS. 3, 4 and 5, in assembly, the first barbs 331 of the retaining arms 33 of the stuffer 30 latch in the retaining holes 191 of the retaining ears 19 of the insulative housing 10. At this time, the pressing plate 32 doesn't extend into the slot 15, but the stuffer 30 is preliminarily positioned relative to the insulative housing 10 and sidewise movement thereof is prevented. A mating end 41 of the first flexible cable 40 having metal contacting pads 411 on one side surface thereof is then horizontally inserted into the first groove 317 of the stuffer 30. After passing through the first groove 317, the mating end 41 is bent downwardly through the cutout 319 along one side surface of the pressing plate 32 and extends into the slot 15 of the insulative housing 10. A mating end 51 of the second flexible cable 50 having metal contacting pads 511 on one side surface thereof is inserted through a space defined between the base plate 31 of the stuffer 30 and the top surface 11 of the insulative housing 10 and then bent downwardly into the slot 15 of the insulative housing 10 along the other side surface of the pressing plate 32. Now the mating ends 41, 51 of the first and the second flexible cables 40, 50 are respectively located on the two side surfaces of the pressing plate 32. By downwardly pressing the stuffer 30, the second barbs 332 of the retaining arms 33 latch with the retaining holes 191 of the retaining ear 19. At this time, the pressing plate 32 of the stuffer 30 is completely pressed into the slot 15 of the insulative housing 10. The second flexible cable 50 is received in the second groove 318 of the stuffer 30. An electrical connection is thus achieved between the metal contacting pads 411, 511 of the mating ends 41, 51 of the first and the second flexible cables 40, 50 and the first contact portions 21 of the conductive terminals 20 extending into the slot 15. The first and the second grooves 317, 318 defined in the base plate 31 of the stuffer 30 allow tail ends 42, 52 of the first and the second flexible cables 40, 50 to extend laterally from the insulative housing 10, thereby reducing the overall height of the whole flexible cable connector assembly and decreasing occupied space in an electronic device to comply with the requirement of compact size.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a top surface defining a slot;

a plurality of conductive terminals received in the insulative housing and partially projecting into the slot; and a stuffer comprising a base plate having a lower surface and opposite side surfaces, a pressing plate downwardly extending from the lower surface of the base plate, and a groove defined in one side surface of the base plate and extending towards the other side surface of the base plate for allowing a flexible cable to extend horizontally therethrough;

wherein when the stuffer is mounted onto the insulative housing, the pressing plate extends into the slot of the insulative housing, the base plate covers the insulative housing, and the groove of said stuffer communicates with the slot of said insulative housing; wherein the insulative housing comprises a pair of retaining ears respectively formed on opposite ends thereof, each retaining ear defining a retaining hole; wherein the stuffer comprises a pair of clasping arms downwardly extending from opposite respective ends of the base plate, each clasping arm having a hook formed at a bottom end thereof adapted for engaging with a complementary connector; wherein the stuffer comprises a pair of retaining anus downwardly extending from the lower surface of said base plate and adjacent to said clasping arms for engaging with said retaining ears of the insulative housing.

2. The electrical connector as claimed in claim 1, wherein the insulative housing defines a plurality of first terminal passageways on one side of the slot thereof.

3. The electrical connector as claimed in claim 2, wherein the insulative housing comprises a channel defined in a lower surface thereof, and a baffle plate disposed between the channel and said slot.

4. The electrical connector as claimed in claim 3, wherein the insulative housing comprises a mating plate downwardly extending from the baffle plate, the mating plate defining a plurality of second terminal passageways in one side surface thereof, each second terminal passageway passing through the baffle plate and in communication with a corresponding first terminal passageway.

5. The electrical connector as claimed in claim 4, wherein each conductive terminal comprises a first contact portion received in said first terminal passageway and a second contact portion received in said second terminal passageway.

6. The electrical connector as claimed in claim 1, wherein each retaining arm has a first barb and a second barb formed on one side thereof for latching with the retaining hole of a corresponding retaining ear.

7. The electrical connector as claimed in claim 1, wherein each retaining arm and the pressing plate defines a gap therebetween.

8. The electrical connector as claimed in claim 1, wherein the base plate of the stuffer defines a cutout in said the other side surface thereof, and the groove communicates with the slot via the cutout.

9. A flexible cable connector assembly comprising:

an insulative housing defining a receiving slot extending along a longitudinal direction thereof, said receiving slot communicating with an exterior through a face of the housing;

at least one row of terminals disposed in the housing by one side of said receiving slot along said longitudinal direction, said terminals communicatively extending into said receiving slot;

a stuffer inserted into the receiving slot through said face along an insertion direction perpendicular to said longitudinal direction, and confronting the corresponding terminals;

a flexible cable extending into the receiving slot via said face, a front end portion of the flexible cable being sandwiched between the stuffer and the corresponding terminals; wherein said stuffer defines a groove via which portions of the flexible cable other than the front end portion guidably extends away from the connector in a second direction laterally angled from the first direction; wherein another row of terminals are disposed in the housing by the other side of the receiving slot, said another row of terminals communicatively extending into the receiving slot, and another flexible cable is inserted into the receiving slot via said face and sandwiched between the stuffer and said another row of terminals; wherein another groove is formed in the stuffer to have said another flexible cable extend therethrough, thus both said two cables laterally extending away from the connector via a same side of said connector.

10. The assembly as claimed in claim 9, wherein said second direction is perpendicular to said first direction.

11. The assembly as claimed in claim 10, wherein said second direction is perpendicular to said longitudinal direction.

12. The assembly as claimed in claim 9, wherein both said two grooves are parallel to each other.

* * * * *